US010040520B2

(12) United States Patent
Venables et al.

(10) Patent No.: US 10,040,520 B2
(45) Date of Patent: Aug. 7, 2018

(54) AC SERVO MOTOR HYDRAULIC UNITS FOR SHIP MOTION CONTROL

(71) Applicants: John D. Venables, Monroe, CT (US); Christopher M. Pappas, Saint Leonard, MD (US)

(72) Inventors: John D. Venables, Monroe, CT (US); Christopher M. Pappas, Saint Leonard, MD (US)

(73) Assignee: Naiad Maritime Group, Inc., Shelton, CT (US)

( * ) Notice: Subject to any disclaimer, the term of this patent is extended or adjusted under 35 U.S.C. 154(b) by 385 days.

(21) Appl. No.: 14/507,498

(22) Filed: Oct. 6, 2014

(65) Prior Publication Data

US 2015/0096436 A1 Apr. 9, 2015

Related U.S. Application Data

(60) Provisional application No. 61/886,905, filed on Oct. 4, 2013.

(51) Int. Cl.
*F15B 15/18* (2006.01)
*B63B 39/06* (2006.01)

(52) U.S. Cl.
CPC ..... *B63B 39/06* (2013.01); *F15B 15/18* (2013.01); *F15B 2211/27* (2013.01); *F15B 2211/6336* (2013.01); *F15B 2211/71* (2013.01); *F15B 2211/78* (2013.01)

(58) Field of Classification Search
CPC ..... B63B 39/06; F15B 15/18; F15B 2211/27; F15B 2211/6336; F15B 2211/71; F15B 2211/78
See application file for complete search history.

(56) References Cited

U.S. PATENT DOCUMENTS 2,979,010 A * 4/1961 Braddon ..... B63B 39/06 114/126
3,020,869 A * 2/1962 Beach ..... B63B 39/06 114/126
3,066,634 A * 12/1962 Suberkrub ..... B63B 39/06 114/126
3,618,553 A * 11/1971 Ehluss ..... B63B 39/06 114/126

(Continued)

FOREIGN PATENT DOCUMENTS

CN 102336254 A 2/2012
EP 1835181 A2 9/2007

(Continued)

OTHER PUBLICATIONS

International Search Report and Written Opinion of the International Searching Authority Application No. PCT/US2014/059263 Completed: Dec. 11, 2014; dated Jan. 2, 2015 11 pages.

*Primary Examiner* — Thomas E Lazo
(74) *Attorney, Agent, or Firm* — St. Onge Steward Johnston and Reens

(57) ABSTRACT

An AC motor hydraulic system which utilizes a plurality of centrally controlled AC servo motor driven hydraulic pumps with integrated reservoirs to effectuate rotation of a plurality of stabilizer fins mounted about a vessel to automatically counter unwanted movement of a vessel.

26 Claims, 5 Drawing Sheets

(56) References Cited

U.S. PATENT DOCUMENTS

| | | | | | |
|---|---|---|---|---|---|
| 3,924,555 | A * | 12/1975 | Napolitano | B63B 39/06 | 114/126 |
| 4,380,206 | A | 4/1983 | Baitis et al. | | |
| 4,388,889 | A | 6/1983 | Baitis et al. | | |
| 4,398,486 | A * | 8/1983 | Woolaver | B63B 39/06 | 114/121 |
| 4,434,739 | A | 3/1984 | Brix et al. | | |
| 4,449,469 | A | 5/1984 | Woolaver et al. | | |
| 4,777,899 | A * | 10/1988 | Bettcher, Jr. | B63B 39/06 | 114/122 |
| 4,919,064 | A | 4/1990 | Ehluss et al. | | |
| 5,092,801 | A | 3/1992 | McBeth | | |
| 5,150,661 | A | 9/1992 | Rudolf | | |
| 5,427,045 | A | 6/1995 | Fetchko | | |
| 5,919,064 | A | 7/1999 | Petersen et al. | | |
| 6,367,400 | B1 | 4/2002 | Niggemann et al. | | |
| 6,571,724 | B1 | 6/2003 | Shen | | |
| 7,263,942 | B1 * | 9/2007 | Dobashi | B63B 39/06 | 114/122 |
| 8,534,211 | B2 | 9/2013 | Venables et al. | | |
| 8,583,300 | B2 | 11/2013 | Oehlgrien et al. | | |
| 8,794,171 | B2 * | 8/2014 | Jauncey | B63H 25/06 | 114/162 |
| 2009/0282823 | A1 * | 11/2009 | Redfern | B63H 25/30 | 60/431 |
| 2012/0132120 | A1 * | 5/2012 | Gai | B63H 25/22 | 114/150 |

FOREIGN PATENT DOCUMENTS

| | | | |
|---|---|---|---|
| GB | 471220 | A | 8/1937 |
| GB | 2235662 | A | 3/1991 |
| WO | 03053775 | A1 | 7/2003 |
| WO | 2014009372 | A1 | 1/2014 |

* cited by examiner

AC SERVO MOTOR HYDRAULIC UNITS FOR SHIP MOTION CONTROL

FIELD OF THE INVENTION

This application relates to the field of automatic stabilization of a vessel, particularly by using stabilization fins rotated by a servo motor hydraulic unit controlled by a central stabilization controller.

BACKGROUND OF THE INVENTION

Traditionally, motion control devices for marine vessels, such as fin roll stabilizers, have been powered hydraulically. In this application, hydraulics offer distinct advantages over other methods of providing power, such as electric motors. For instance, hydraulic actuators, or cylinders, can deliver a tremendous amount of force in a relatively small package, with little to no backlash or physical wear.

The drawbacks of traditional hydraulic systems are numerous. First, traditional hydraulic systems require numerous components and large plumbing systems spread out about the vessel, especially when multiple fin stabilizers are used. These systems must be fitted to the engine or generator's power take off, or to separate electric motors. A reservoir must be installed to supply the hydraulic pumps with fluid. The fluid must be clean and kept from overheating, so filters and a cooling system must be installed. An intricate network of hoses and pipes must be maintained to keep hydraulic fluid flowing to and from each and every hydraulic system component and consumer. With so many components, these systems can be costly to acquire and install, and need to be continually and carefully maintained.

The alternative to traditional hydraulic systems has been the use of electric motors to rotate the fins either directly or through a reduction gear. Direct drive motors are necessarily rather large due to the high torque requirements of a fin stabilizer. Adding a reduction gear between the motor and the fin can reduce the size requirement of the motor, but at the expense of the gear arrangement being subject to wear and backlash. In either case, the motors would be at risk of overheating and would require a cooling system.

SUMMARY OF THE INVENTION

In order to combine the benefits and eliminate the drawbacks of both systems, the present invention provides a new method of powering ship motion control equipment. The invention utilizes a number of AC servo motor driven hydraulic pumps with integrated reservoirs in compact, self-contained packages, with no expensive plumbing to install. The units mount on or near the fin actuation methods. A closed loop hydraulic system is used, requiring far less hydraulic fluid than traditional open loop hydraulic systems.

The units are designed to operate only when commanded. When stabilization is paused, and between fin movement commands, the AC motor and hydraulic pump stop. This is in contrast to traditional hydraulic systems, which continuously run regardless of whether the system is being utilized. This results in an energy efficient solution with far less heat generation than a traditional system. Accordingly, there is no need for a cooling system, and fluid filtration can be integrated within the unit.

As the vessel beings to move due to waves, wakes, or swells in the water, a motion sensor detects the angle and the rate of motion of the vessel. A signal is sent from the motion sensor to a stabilization controller. The stabilization controller processes the data and determines an appropriate corrective fin response. A command is then sent to the appropriate AC servo motor hydraulic units. The command is received in-unit by the AC servo controller, which sends the required direction and speed commands to the AC motor. The AC motor turns the pump to produce the necessary pressure and flow of hydraulic fluid to extend or retract one or more hydraulic actuators or cylinders. This displaces the tiller arm associated with the AC servo motor hydraulic unit, and in turn rotates the fin.

The present invention offers many unique advantages over the prior art, including, but not limited to those described herein. First, the present invention has built in redundancy, unlike a stabilizer powered by a central hydraulic system. If one unit fails, the remaining unit(s) can continue functioning. If there is a failure in a central hydraulic system, all stabilizer function is disabled. Spare units can also be kept on board in the event of a problem, and to rotate units out of service for maintenance while underway with a minimal loss of motion control.

Second, the present invention provides environmental advantages over traditional solutions. In the event of a fluid leak, a traditional central hydraulic system's pipe or hose can expel nearly all the hydraulic fluid in the system in a very short amount of time. The compact, closed loop AC Servo Hydraulic Unit limits fluid loss to about a gallon, while an open loop central hydraulic system can lose 20 or 30 times that amount.

Third, the present invention is also much quieter than the prior art. A central hydraulic system transmits noise from the pump, the motor, and throughout the plumbing, making it difficult to contain. The AC Servo Hydraulic Unit, along with the fin actuator can be isolated in an enclosure, and/or noise damping material.

Fourth, the present invention also has the benefit of being very versatile. The hydraulic power units can be fitted with various size motors, pumps and reservoirs to meet the demand of the application, and configured to suit the available space.

DETAILED DESCRIPTION OF THE INVENTION

Figure 1:
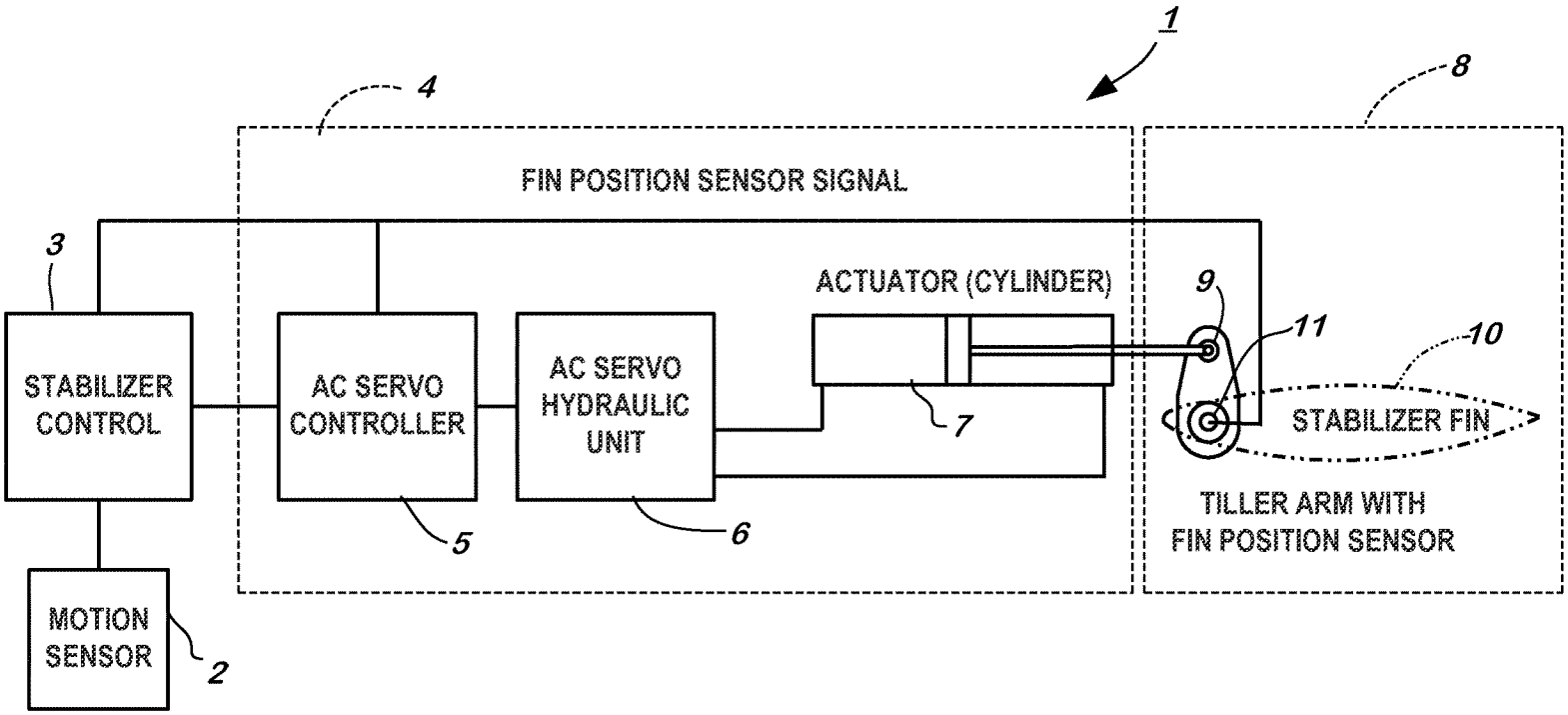
FIG. 1 is a functional diagram of the servo motor hydraulic system of the present invention.

FIG. 1 shows an embodiment of servo motor hydraulic system 1. Motion sensor 2 first detects the movement of the ship. In other embodiments of the invention, motion sensor 2 detects roll, pitch, yaw, velocity, speed, or any other attribute of motion, or a combination thereof. In some embodiments of the invention, motion sensor 2 primarily detects the roll of a ship.

Motion sensor 2 then communicates this motion information to stabilization controller 3. Stabilization controller 3 then determines the appropriate righting movements based on the information from motion sensor 2. In an embodiment of the invention, stabilization controller 3 also takes into account the present position fin 10, which is periodically reported by fin position sensor 11. In some embodiments of the invention, the fin's 10 rotational position are reported; in others, the fin's 10 linear position is reported. In embodiments of the invention, the fin's position is measured either directly or indirectly.

Stabilization controller 3 then sends the appropriate commands to actuate the movement of the fin to servo motor hydraulic assembly 4. Servo controller 5 receives the commands from stabilization controller 3 and in turn sends the appropriate command to start servo motor hydraulic unit 6. Servo motor hydraulic unit 6 causes a pressure change in hydraulic actuator 7, which activates fin movement assembly 8. Tiller arm 9 moves as a result of its communication with hydraulic actuator 7 and converts the linear movement of the hydraulic actuator 7 to a torque, which rotates fin 10.

In some embodiments of the invention, hydraulic actuator 7 comprises multiple hydraulic actuators which are in communication with fin movement assembly 8.

In some embodiments of the invention, fin position sensor 11 periodically determines the position of fin 10 and updates stabilization controller 3 and servo controller 5 with the position of fin 10. In some embodiments of the invention, when fin 10 reaches a desired position, stabilization controller 3 or servo controller 5 sends a command to halt further movement of fin 10.

Figure 2:
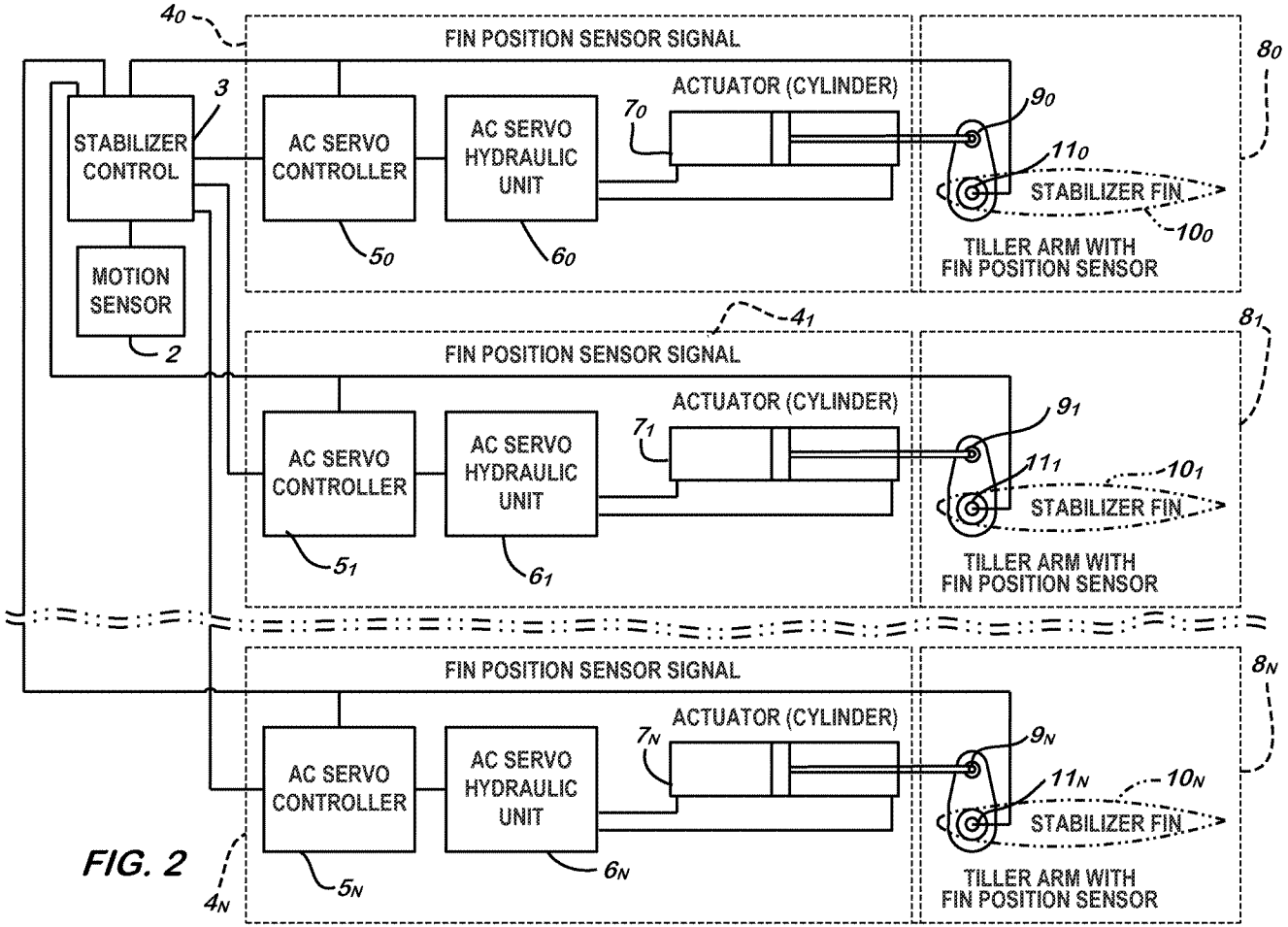
FIG. 2 is a functional diagram of the servo motor hydraulic system of the present invention utilizing multiple servo motor hydraulic assemblies and fin movement assemblies.

FIG. 2 shows an embodiment of the servo motor hydraulic system wherein multiple servo hydraulic assemblies $\mathbf{4}_0$, $\mathbf{4}_1 \ldots \mathbf{4}_N$ and multiple associated fin movement assemblies $\mathbf{8}_0$, $\mathbf{8}_1 \ldots \mathbf{8}_N$ are in communication with a single stabilization controller 3. The system works in primarily the same way as the embodiment shown in FIG. 1. However, in some embodiments of the invention, stabilization controller 3 takes into account the number, location on the ship, and/or the current rotational or linear position of fins $\mathbf{10}_0$, $\mathbf{10}_1 \ldots \mathbf{10}_N$ when determining an appropriate righting movement. In an embodiment of the invention, servo motor hydraulic assemblies $\mathbf{4}_0$, $\mathbf{4}_1 \ldots \mathbf{4}_N$ are given and effectuate different repositioning commands to counteract the motion of the ship by moving associated fins $\mathbf{10}_0$, $\mathbf{10}_1 \ldots \mathbf{10}_N$. In an embodiment of the invention, servo motor hydraulic assemblies $\mathbf{4}_0$, $\mathbf{4}_1 \ldots \mathbf{4}_N$ are given and effectuate the same repositioning commands to counteract the motion of the ship by moving associated fins $\mathbf{10}_0$, $\mathbf{10}_1 \ldots \mathbf{10}_N$.

Figure 3:
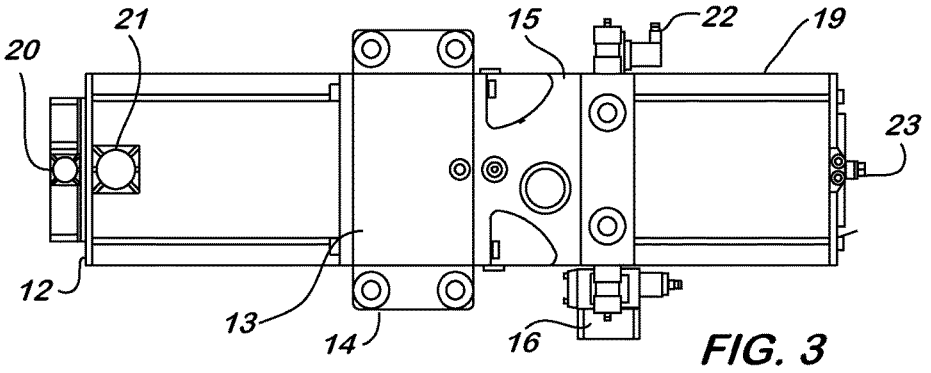
FIG. 3 is a top view of the servo motor hydraulic unit of the present invention.

FIG. 3 shows an embodiment of servo motor hydraulic unit 6. AC servo motor 12 receives commands from servo controller 5 via either miscellaneous port 20 or 21. The motor 12 is connected to pump 15 via pump/motor interface 13. When the motor 12 is activated, the pump 15 changes pressure in hydraulic actuator 7 by moving fluid through ports 17 and 18.

Pump 15 is fed by integrated reservoir 19, and is in communication with valving 16 for shutoff, flushing and pressure relief. In some embodiments of the invention, servo motor hydraulic unit can be mounted via unit mounting base 14. In some embodiments of the invention, miscellaneous ports 22 and 23 can be configured to provide various functions.

Figure 4:
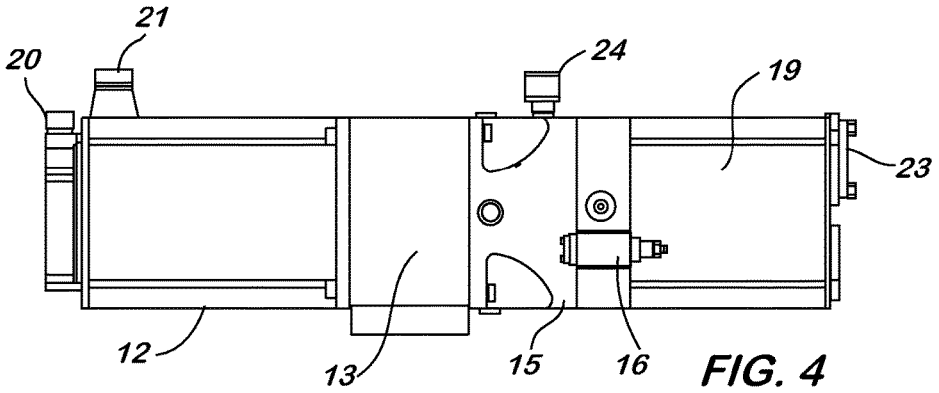
FIG. 4 is a side view of the servo motor hydraulic unit of FIG. 3.

FIG. 4 shows a side view of the embodiment of the invention shown in FIG. 3. Miscellaneous port 24 can be configured to provide various functions.

Figure 5:
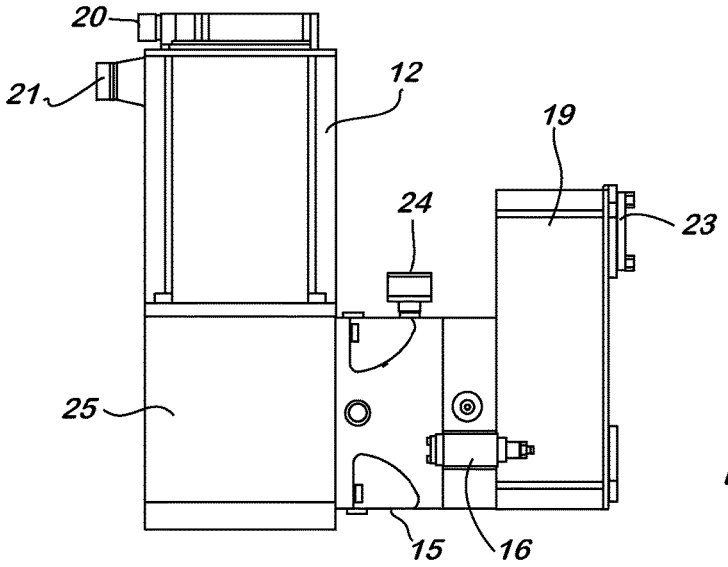
FIG. 5 is an alternate embodiment of a top view of the servo motor hydraulic unit of FIG. 3 with a right angle gear box.

FIG. 5 shows an embodiment of the invention in which AC servo motor 12 and pump 15 are situated ninety degrees apart and connected via right angle gear box 25.

Figure 6:
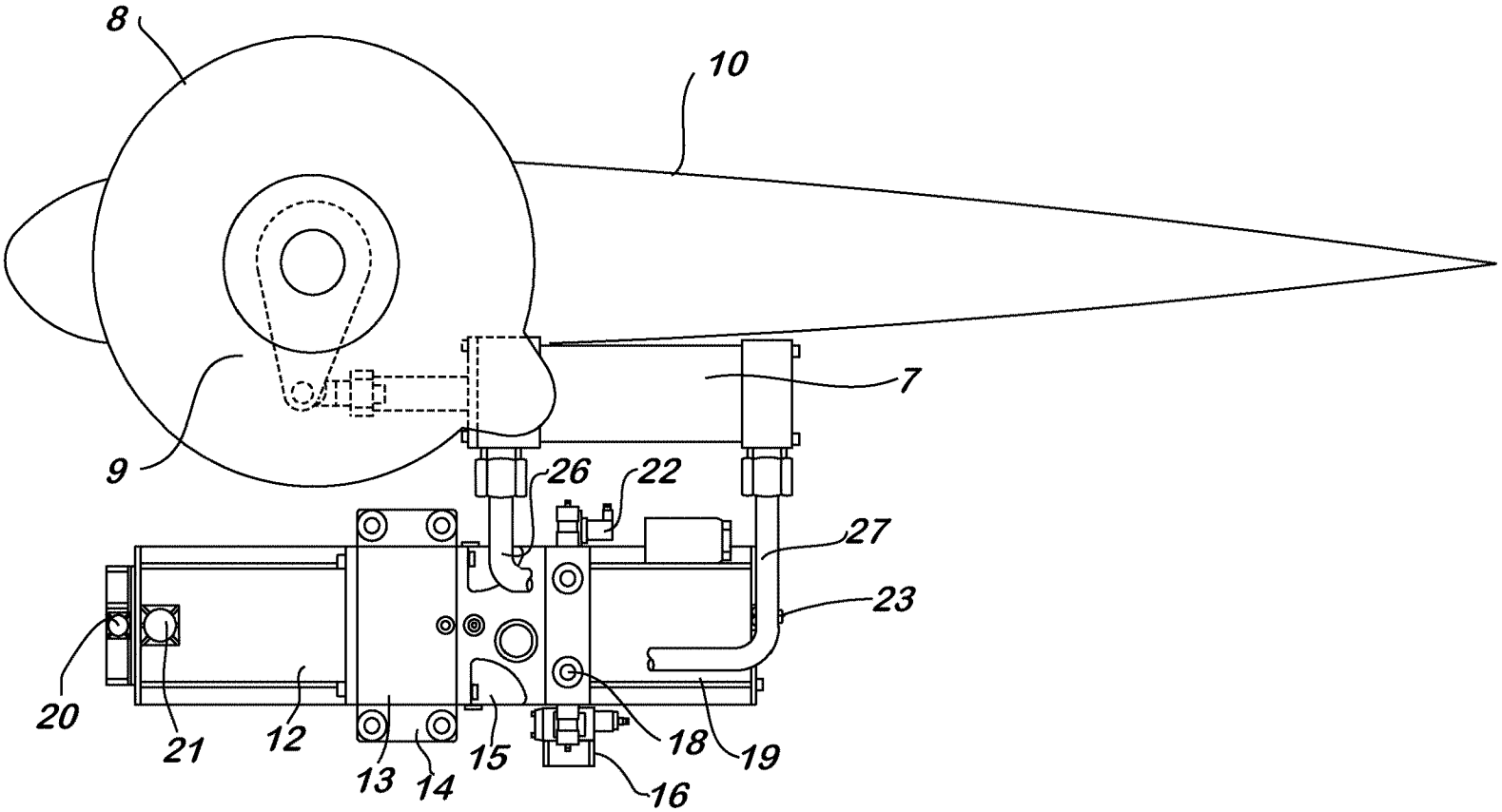
FIG. 6 is a top view of the servo motor hydraulic unit of FIG. 3 with an attached fin movement assembly.

FIG. 6 shows an embodiment of the invention in which servo motor hydraulic unit 6 of FIG. 3 is in communication with hydraulic actuator 7 and fin movement assembly 8. Pump 15 changes the pressure in hydraulic actuator 7 by moving hydraulic fluid through ports 17 and 18 and hydraulic lines 26 and 27. In response to the movement of hydraulic actuator 7, tiller arm 9 converts the linear motion of hydraulic actuator 7 to torque, effectuating a rotation of fin 10.

Figure 7:
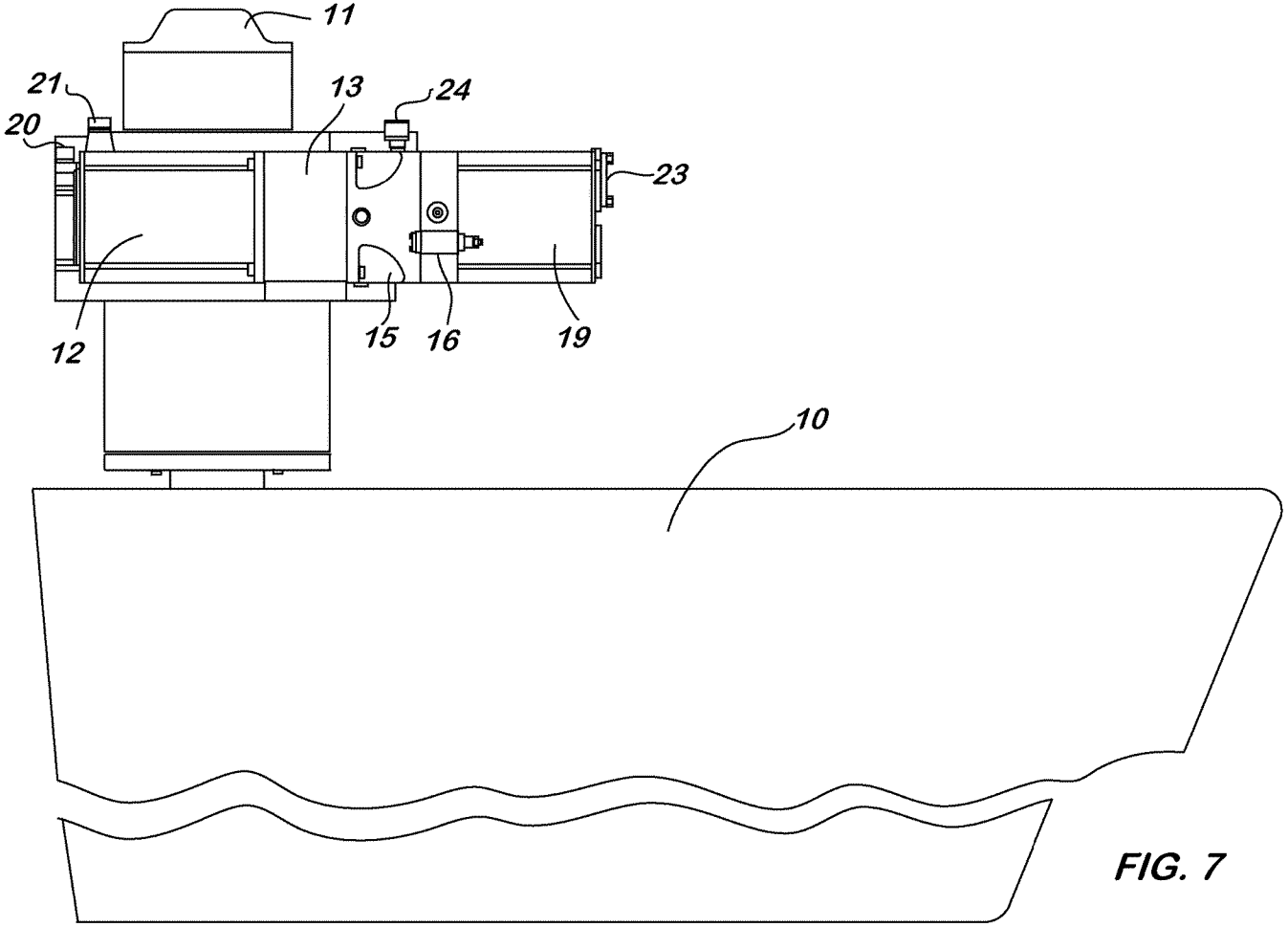
FIG. 7 is a side view of the servo motor hydraulic unit of FIG. 3 with an attached fin movement assembly.

FIG. 7 shows a side view of FIG. 6 with fin position sensor 11 clearly shown. In some embodiments, sensor 11 is in communication with its associated servo controller 5 and stabilizer controller 3 to provide periodic updates on the position of the fin.

What is claimed is:

1. A servo motor hydraulic system for ship motion control, comprising:

a motion sensor;

a stabilization controller in communication with the motion sensor, said stabilization controller receiving and processing data and determining righting movements;

a plurality of servo motor hydraulic assemblies, each assembly comprising its own:

servo controller in communication with the stabilization controller;

servo motor in communication with the servo controller to allow the servo motor to receive signals to drive the servo motor;

hydraulic pump which is driven by the servo motor;

hydraulic actuator in communication with the hydraulic pump wherein said hydraulic actuator includes a hydraulic cylinder and piston assembly;

wherein the servo controller receives commands from the stabilization controller and commands the servo motor to change a direction with which the servo motor is driven to thereby change a direction with which the hydraulic pump is driven, wherein the commands extend or retract the actuator thereby causing rotation of at least one of said plurality of fins; and an integrated reservoir which is in communication with the hydraulic pump;

a plurality of bodies, each in communication with the actuator of a servo motor hydraulic assembly;

wherein upon the extension or retraction of the actuator, said bodies produce the desired righting movements;

wherein each one of said plurality of servo motor hydraulic assemblies is its own closed loop hydraulic system.

2. The servo motor hydraulic system of claim 1, further comprising a plurality of body position sensors in communication with its own body of the plurality of bodies, and in further communication with its own servo controller and the stabilization controller, wherein the body position sensors periodically detect and report the position of the body it senses.

3. The servo motor hydraulic system of claim 2, wherein the position of the body that is reported is angular position.

4. The servo motor hydraulic system of claim 1, wherein the bodies comprise a tiller arm and a rotating fin.

5. The servo motor hydraulic system of claim 1, wherein each one of the plurality of servo motor hydraulic assemblies is a closed loop.

6. The servo motor hydraulic system of claim 1, wherein said hydraulic actuator is a plurality of hydraulic actuators.

7. The servo motor hydraulic system of claim 1, wherein the motion sensor detects roll.

8. The servo motor hydraulic system of claim 1, wherein the servo motor and hydraulic actuator, while the servo motor hydraulic system is turned on, stop work when stabilization is paused or when a desired body position is reached.

9. The servo motor hydraulic system of claim 1, wherein each one of the plurality of servo motor hydraulic assemblies is installed on or near the body it is in communication with.

10. The servo motor hydraulic system of claim 1, further comprising a fluid filtration system integrated within the servo hydraulic unit.

11. The servo motor hydraulic system of claim 1, wherein the servo controller and servo motor are powered by alternating current.

12. The servo motor hydraulic system of claim 1 wherein the commands include commands to change a speed of the servo motor.

13. A servo motor hydraulic system for ship motion control, comprising:

a plurality of fins;

a plurality of tiller arms, each in communication with a fin;

a plurality of servo motor hydraulic assemblies, each assembly comprising its own:

at least one hydraulic actuator in communication with a tiller arm;

hydraulic pump in communication with the at least one hydraulic actuator;

servo motor which drives the hydraulic pump;

servo controller in communication with the servo motor;

wherein said servo motor receives commands from the servo controller to extend or retract the at least one hydraulic actuators thereby causing rotation of at least one of said plurality of fins; and an integrated reservoir which is in communication with the hydraulic pump;

a stabilization controller in communication with the servo motor controllers of the plurality of servo motor hydraulic assemblies;

a motion sensor in communication with the stabilization controller;

wherein the stabilization controller receives and processes data from the motion sensor, determines righting movements, and sends appropriate commands to the at least one servo motor controller of the servo motor hydraulic assemblies wherein the servo motor and hydraulic actuator, while the servo motor hydraulic system is turned on, stop work when stabilization is paused or when a desired body position is reached.

14. The servo motor hydraulic system of claim 13, further comprising a plurality of body position sensors in communication with its own body of the plurality of bodies, and in further communication with its own servo controller and the stabilization controller, wherein the body position sensors periodically detect and report the position of the body it senses.

15. The servo motor hydraulic system of claim 13, wherein the servo motor hydraulic unit is closed loop.

16. The servo motor hydraulic system of claim 13, wherein the motion sensor detects roll.

17. The servo motor hydraulic system of claim 13, wherein the servo motor and hydraulic actuator stop work when stabilization is paused or when a desired fin position is reached.

18. The servo motor hydraulic system of claim 13 wherein the commands include commands to change a speed of the servo motor.

19. A method of ship motion control, comprising the steps of:

sensing the motion of a ship;

determining appropriate righting movements based on the motion of the ship;

signaling a plurality of electric motors with a direction command wherein each of the plurality of electric motors corresponding to one of a plurality of integrated servo motor driven hydraulic pumps which drive a hydraulic cylinder and piston assembly to effectuate rotation of a plurality of bodies to provide an appropriate righting movement said signaling modifying a direction of a hydraulic pump of the plurality of integrated servo motor driven hydraulic pumps.

20. The method of ship control of claim 19, further comprising the steps of:

observing the current positions of the plurality of bodies;

utilizing body position data in determining appropriate righting movements.

21. The method of ship control of claim 19, further comprising the step of utilizing body position data to stop the operation of an appropriate servo motor driven hydraulic pump when the associated body has reached an appropriate righting position.

22. The method of claim 19 wherein each integrate servo motor driven hydraulic pumps includes its own reservoir.

23. The method of claim 19 wherein said signaling step further includes a speed command to modify a speed of the electric motors.

24. A servo motor hydraulic system for ship motion control, comprising:

a plurality of fins;

a plurality of tiller arms, each in communication with a fin;

a plurality of servo motor hydraulic assemblies, each assembly comprising its own:

at least one hydraulic actuator in communication with a tiller arm;

hydraulic pump in communication with the at least one hydraulic actuator;

servo motor which drives the hydraulic pump;

servo controller in communication with the servo motor;

wherein said servo motor receives commands from the servo controller to extend or retract the at least one hydraulic actuators thereby causing rotation of at least one of said plurality of fins; and an integrated reservoir which is in communication with the hydraulic pump;

a stabilization controller in communication with the servo motor controllers of the plurality of servo motor hydraulic assemblies;

a motion sensor in communication with the stabilization controller;

wherein the stabilization controller receives and processes data from the motion sensor, determines righting movements, and sends appropriate commands to the at least one servo motor controller of the servo motor hydraulic assemblies to change a fin position wherein between commands and while the servo motor hydraulic system is activated the servo motor and hydraulic actuator stop work.

25. The servo motor hydraulic system of claim 24 wherein the commands include commands to change a direction of the servo motor to thereby change a direction of the hydraulic pump.

26. The servo motor hydraulic system of claim 25 wherein the commands include commands to change a speed of the servo motor.

* * * * *